United States Patent [19]

Stewart et al.

[11] Patent Number: 5,022,310

[45] Date of Patent: Jun. 11, 1991

[54] FLUID POWER TRANSMISSION

[76] Inventors: Robert M. Stewart; Carlene M. Stewart, both of 325 Baypark Dr., Brandon, Miss. 39042

[21] Appl. No.: 320,760

[22] Filed: Mar. 7, 1989

[51] Int. Cl.[5] ..... F01B 3/00

[52] U.S. Cl. ..... 91/501; 417/269

[58] Field of Search ..... 91/505, 507, 501, 488; 417/269

[56] References Cited

U.S. PATENT DOCUMENTS

| | | | |
|---|---|---|---|
| 1,020,285 | 3/1912 | Janney . | |
| 1,263,180 | 4/1918 | Williams . | |
| 1,274,391 | 8/1918 | Davis . | |
| 2,146,133 | 2/1939 | Teedale . | |
| 2,157,692 | 5/1939 | Doe . | |
| 2,313,407 | 3/1943 | Vickers . | |
| 2,776,628 | 1/1957 | Keel . | |
| 2,821,932 | 2/1958 | Lucien | 417/269 |
| 2,834,297 | 5/1958 | Postel . | |
| 3,108,543 | 10/1963 | McGregor . | |
| 3,183,845 | 5/1965 | Tyler . | |
| 3,237,569 | 3/1966 | Reaume . | |
| 3,295,457 | 1/1967 | Oram . | |
| 3,386,389 | 6/1968 | Thoma | 91/501 |
| 3,407,745 | 10/1968 | North et al. | 91/501 |
| 3,627,451 | 12/1971 | Kouns . | |
| 3,742,819 | 7/1973 | Freese | 91/505 X |
| 3,981,630 | 9/1976 | Leduc et al. | 417/269 |

*Primary Examiner*—Edward K. Look

[57] ABSTRACT

This application is for a lightweight variable displacement rotary fluid power machine, including a housing, within which a rotary cylinder barrel shaft is suitably mounted for rotation about a shaft axis. The shaft includes a plurality of open ended cylinder bores disposed in a circumferential array around its longitudinal axis. A tubular shaped fluid conduit telescoping sleeve type compression device, having sliding bearing type piston shoes at each end, is disposed to reciprocate within each cylinder bore, extending therefrom to engage adjustable camming means in sliding contact. A novel fluid valving mechanism is used, which interacts with arcuate slots on the camming surface, to communicate with each telescoping compression device and connect it, in a rotationally phased manner, with inlet and outlet fluid. Load bearing conditions are improved which enhance speed capabilities.

Tubular shaped fluid conduit pistons are also used in a non-telescoping manner with the above novel valving apparatus. This device has piston bores, in a rotary cylinder barrel, that are closed at one end. It achieves certain improvements over popular inline piston type fluid power machines. The non-telescoping arrangement is also used in an integrated fluid power motor/-pump device which uses common structure to improve load bearing conditions. This arrangement can also be used to construct a fluid pressure intensifier, or dual motor rotary actuator, or integrated double pump, or an integrated electric motor/pump power transformer or other such devices.

14 Claims, 10 Drawing Sheets

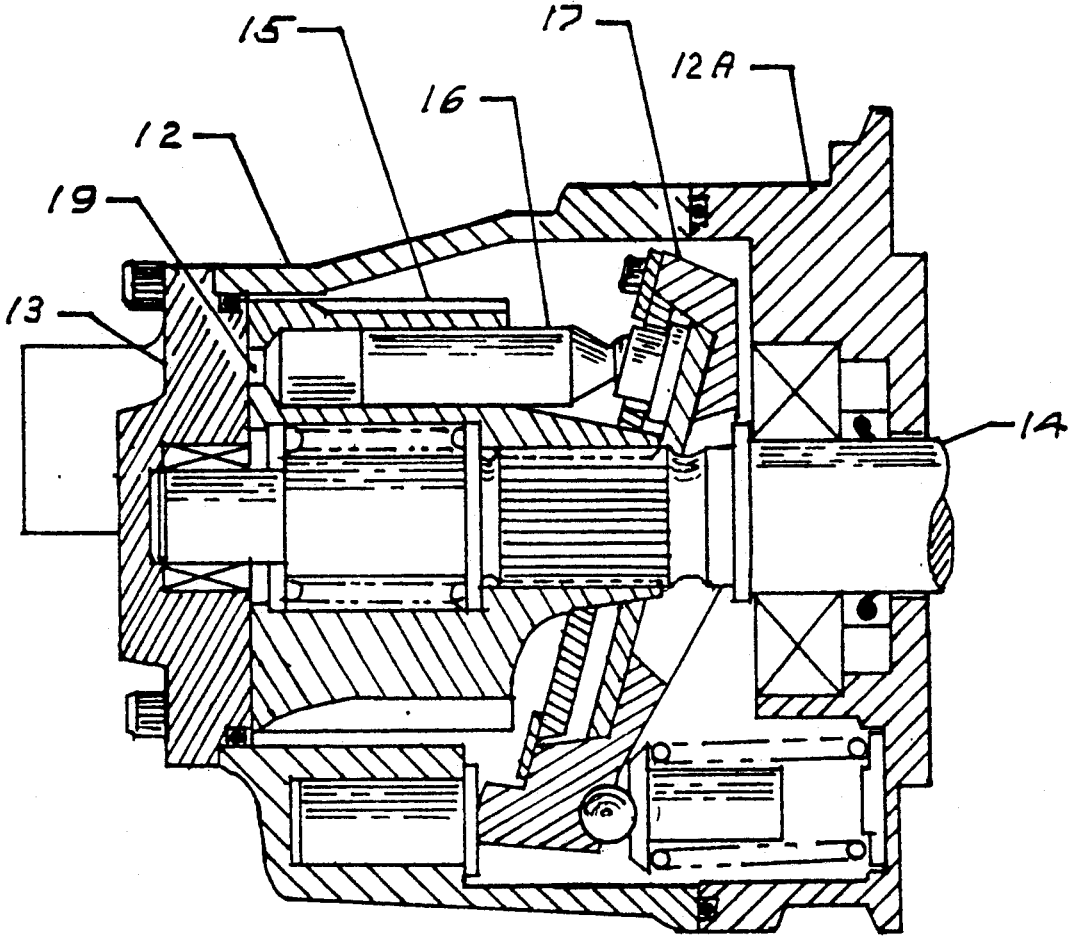
FIGURE 1 - PRIOR ART
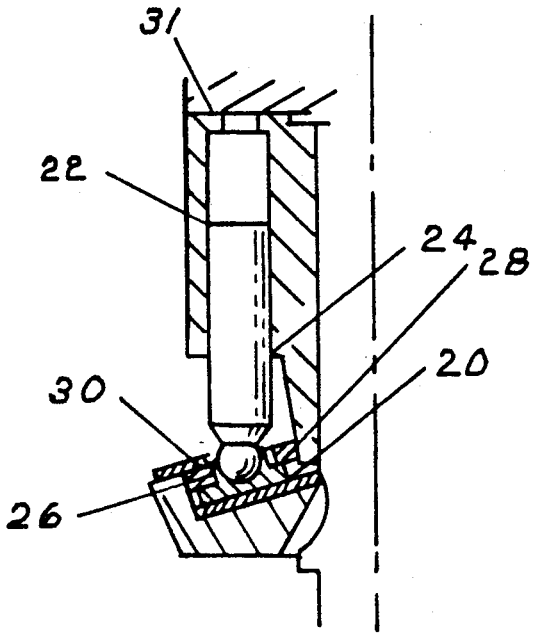
FIGURE 1A - PRIOR ART

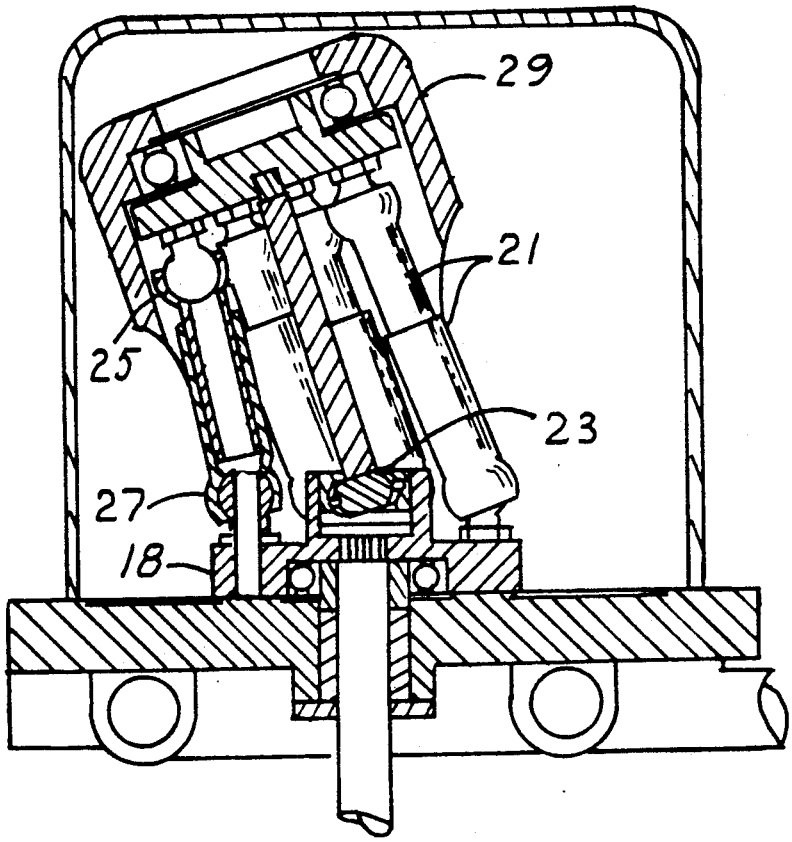
FIGURE 2 - PRIOR ART

FLUID POWER TRANSMISSION

BACKGROUND—FIELD OF INVENTION

This invention relates to fluid power mechanical devices of the type that use reciprocating pistons in sleeves or in rotary cylinder barrels and specifically to an improved means of: (i) communicating the primary working fluid to and from the pistons (ii) varying displacement of the mechanism and (iii) improving some of the critical bearing load conditions.

For the purpose of convenience the invention will be described as a fluid pump, but it should be understood that the term pump when used hereafter embraces both a fluid pump and a fluid motor; also the term fluid embraces both the liquid or gaseous state or some mixture thereof.

BACKGROUND—DISCUSSION OF PRIOR ART

The fluid power transmissions over which this invention has significant improvements are pumps, such as that shown in cross section view in FIG. 1, that generally comprise a hollow case or housing, 12 and 12A, within which is a rotatable shaft 14 and rotary cylinder barrel 15 that has a plurality of cylinder bores within which pistons 16 reciprocate, each piston 16 having sliding shoes attached and extending from rotary cylinder barrel 15 to directly abut camming means, such as tilt thrust plate mechanism 17, or being associated therewith by means of articulated connecting rods. The cylinder barrel 15 rotates against a flat plate valving means 13 which has arcuate inlet and outlet kidney shaped slots that serve as ports to accomplish a valving mechanism, in a well-known manner, to provide properly phased or timed communication between end ports of cylinder bores 19, within which pistons reciprocate, and inlet and outlet passages of the device. The pump shown in FIG. 1, heretofore has been the design of choice for applications where the need is for lightweight, small size, high performance, high reliability and long service life, such as in aircraft fluid power systems. Component designers address these needs by diligently applying advances in the technology of materials plus fabrication methods and processes. However, as the needs become more demanding the cost to manufacture the components increases. Other than fine tuning for performance, minimal change in pump concept has evolved in recent years, thereby causing a long felt need for novel improvement to the pumping mechanism.

The pump shown in FIG. 1 has evolved from combining and thrustimproving on features of earlier patents; such as the tilt thrust plate of R. Janney, #1,020,285; the inline piston with sliding shoe of W. M. Davis, #1,274,391; and the spline shaft driven rotary cylinder block of A. Keel, #2,776,628 as well as others.

The basic principle of inline rotary piston pump devices is: the axis of a thrust plate member is inclined relative to the axis of rotation of a cylinder barrel, which contains pistons along its longitudinal axis. Rotating the cylinder barrel reciprocates the pistons. The total displacement of the device is resolved by the relative angle of inclination between the axes of the two members. Displacement of each piston is determined by the area of the cylinder bore and the length of stroke of the piston; and the length of stroke of the piston is determined by the relative angle of inclination between the axis of rotation of the cylinder barrel and the axis of the thrust plate member.

It has been the practice, therefore, to vary the displacement of such devices by providing mechanism for; changing the angle of tilt of the thrust plate member, as shown in FIG. 1; or providing a swinging yoke for changing the angle of tilt of the cylinder barrel to vary piston stroke length; or to rotate the valving means. These adjusting mechanisms may be manually or fluid pressure operated. Examples of such forms of variable displacement devices are described in Patents No. 2,565,208 to J. Dietiker, No. 2,776,628 to A. Keel, and No. 3,237,56 to L. V. Reaume.

Patents #2,157,692, T. B. Doe and #2,146,133, R. L. Tweedale and patent #3,108,543, W. McGregor, achieved certain improvements over prior art pumps. The improvement was to use pairs of telescoping sleeves, 21 of FIG. 2, retained by ball socket joints, fixed in place, at their ends with swinging yoke 29 type camming means at one end and valving means 18 at the other end. The sleeve and ball socket 27 at the valving end being hollow to communicate with a flat plate type valving mechanism 18. In these devices working torque was transmitted through several joints. Because angular movement in relation to the line of force was involved at each end 25 and 27 of the telescoping sleeves, an expensive and life limiting universal joint 23 was required to maintain the ends of telescoping sleeves 21 in properly phased rotational alignment; also the individual longitudinal axis of each pair of telescoping sleeves formed variable angles with their corresponding pairs which required the elimination of the well known, and proven, rotary cylinder barrel 15 of FIG. 1. Elimination of the rotary cylinder barrel increased the churning losses because each telescoping sleeve assembly 21 was completely exposed to the fluid in the casing.

Prior art pumps such as Lucien, U.S. Pat. No. 2,821,932 achieved certain improvements using tubular shaped fluid conduit pistons and bearings, however, the concept was not adaptable to variable displacement and also required the use of oscillating non-return check type valves associated with each piston assembly.

Prior art patents such as Thoma U.S. Pat. No. 3,386,389, North U.S. Pat. No. 3,407,745, Freese U.S. Pat. No. 3,407,745 and Leduc U.S. Pat. No. 3,981,630 all teach certain improvements in fluid devices that use tubular shaped fluid conduit pistons and bearings, however, these inventions require the cooperation of reciprocating springs to extract each piston and bearing assembly from its associated cylinder bore and assure the fluid conduit bearing remains in correct contact with the valving surface. Leduc's concept also involves non-return valves actuated by fluid from the reciprocating motion of each piston.

Reciprocating springs and oscillating non-return valves have been shown to have a negative impact on reliability and life of fluid power components. These moving parts also influence the stability of fluid power components. It is therefore desirable to avoid these elements in high performance components.

My invention eliminates the need for reciprocating springs and oscillating non-return valves.

Prior art piston type fluid power transfer units, or so called transformers, such as described in patent 3,627,451, H. H. Kouns, utilize two axial piston pump-motor units comprising separate rotary cylinder barrels joined by an interconnecting shaft. These devices have been used to connect two hydraulic systems or circuits for the purpose of transferring power from either one to the other at the same or a different pressure flow condition. The need for a separate connecting shaft causes them to be complex, long and heavy which is an undesirable characteristic. My invention accomplishes the same result with one common rotary cylinder barrel and thereby fewer elements.

Prior art double pump components, such as described in patent 3,183,845 to H. P. Tyler, used separate cylinder blocks, inter-connected so that the cylinder bores of each cylinder block were indexed out of phase, by a splined coupling shaft, to reduce pressure pulsations. My invention accomplishes the same result with fewer elements; by fabricating cylinder bores from opposite ends of a common rotary cylinder barrel and disposing them out of phase, one end to the other, thereby eliminating the need for a splined shaft and separate rotary cylinder blocks.

Rotary axial piston devices of the FIG. 1 prior art type, have been on the market for years and are proven to be successful, being more adaptable and efficient than other forms of fluid energy translating devices, such as sliding vane and gear type, for extremely high speed and high pressure applications. For example; the driving of aerospace vehicle accessories. Because of the variable displacement actuating mechanism and elements associated therewith, the variable displacement units are substantially larger, with increased weight, and more complex in structure than the fixed displacement devices for the same displacement. Growth of the Robotics Industry, and demands of small lightweight automobiles and aerospace vehicles, is pressing the need for lighter weight and smaller more durable fluid power mechanical devices. The reader will find in an examination of the ensuing objectives, description and discussion of operation that; this invention produces unusual and surprising results which address these long felt needs.

OBJECTIVES AND ADVANTAGES

It is an objective of this invention to utilize pairs of telescoping sleeve type pistons, and a rotary cylinder barrel which transmits the working torque to and from the device through the large well lubricated surface area between a piston and cylinder wall; with consequent improvement in design versatility, wear characteristics, complexity, size, weight, cost and performance.

It is an objective of this invention to increase the displacement volume, without causing undesirable reaction loads, to provide an improved pump or motor construction; wherein the size of the device, per unit of displacement, is decreased with consequent reduction in space and weight. Prior art would take additional space and weigh more than this invention; because it would need to accommodate additional pumping elements, or some combination of increased piston size, greater displacement angle or larger diameter cylinder barrel, to accomplish an equivalent displacement capability.

It is an objective of this invention to improve certain bearing conditions to enhance performance plus extend maximum operating speed capability. A significant speed and pressure limiting factor in prior art is the load carrying capability of sliding bearing surfaces due to their pressure-velocity (PV) factors. That is; the load on the sliding bearing surface, and the speed at which it is moving, is a performance and life limiting factor. Such as; at the piston shoe to bearing plate, surface 20 of FIG. 1A, and at the piston to cylinder barrel rubbing surfaces 22 and 24. In addition to being subject to failure themselves; drag at these surfaces contributes to the pressure velocity loads of other critical surfaces 26, 28, 30 and 31. It is also true in that; due to the dependent relationship of all these surfaces, improvement at one surface can enhance the operating conditions at related surfaces and thereby the group. This invention has improvements over prior art by reducing pressure velocity factors on some of the most critical of these surfaces by: reducing velocity at 20 through rotating the bearing plate for the piston shoes; replacing the sliding bearing at 30 with an anti-friction type bearing thereby reducing the load, under certain operating conditions, at the piston shoe neck 26; reducing the average working load at 22 and 26 by increasing the average length to diameter engagement between the piston and the bore, through the use of two sliding sleeve type pistons moving in opposite directions. Persons familiar with the art will recognize these betterments as improving the performance and service life of the components.

It is an objective of this invention to provide a means for varying displacement by tilting one of two camming surfaces through a larger included angle, that is effective on both sides of an angle perpendicular to the shaft axis; thereby increasing variable displacement volume without causing the adverse loads normally associated with increased displacement angles. In this invention the relationship between: (i) the camming angle displacement from perpendicular, (ii) length to diameter engagement between inner piston 32, see FIG. 3, and outer piston 34, (iii) the engagement between outer piston 34 and rotary cylinder barrel 62, are designed similar to that normally found to be successful in prior art. However, since the total active displacement angle of the invention is much greater than prior art, the average piston to bore engagement (reference FIG. 1A area 22 to 26) is much greater. This improves volumetric efficiency and bore wear characteristics at the average working condition. The result being reduced operating cost and longer service life.

It is an objective of this invention to shorten the necessary length of the pump along the longitudinal axis about which the pumping elements rotate and thereby improve vibration characteristics; because the center of gravity will be closer to the drive end of the pump.

It is an objective of this invention to combine functions of certain parts with consequent reduction in fabrication cost, size and weight. This invention combines some or all of the design function of certain separate parts of prior art into single parts such as: (i) moving the valving function from the face of the rotary cylinder block, 31 FIG. 1A, to the piston shoe bearing plate (ii) combining the corresponding valve block function with the tilt yoke camming plate to eliminate a part referred to as the valve block in prior art. These features are an advantage over prior art because they: reduce fabrication cost with fewer operations needed; reduce weight with fewer parts required; reduce overhung moment by placing the center of gravity closer to the mounting flange which improves vibration characteristics; improve application potential with lower profile and more versatile inlet or outlet locations; reduce high static pressure "O"ring type parting line surface sealing problems, by repositioning a needed high pressure sealing feature from the valve block, shown in FIG. 1.

It is an objective of this invention to enhance potential for fabricating parts with non-metallic materials by confining high stress areas to fewer parts. Consequently items such as the casing can be produced at lower cost.

It is an objective of this invention to reduce the elements required for fluid motor pumps and double pumps, by incorporating the reciprocating activity of two separate pump or motoring groups of axial pistons into one rotary cylinder barrel. Such that; they function as a fluid motor-pump, or double motor, or double pump, that can operate in, or between, separate systems with consequent reduction in cost, weight, complexity and size because; the need for an interconnecting shaft is eliminated allowing for shorter length and more efficient use of supporting bearings and structure.

It is an objective of this invention to reduce fluid pressure pulsations, by incorporating the reciprocating activity of two separate pump or motoring groups of axial pistons into one rotary cylinder barrel, and each separate pump group being disposed out of phase, one group to the other, to reduce pressure pulsations in double pump applications. This arrangement eliminates one rotary cylinder barrel and its support system plus a splined coupling shaft, as required by prior art.

Refer to the Figures and description of the details to examine the forgoing advantages plus some additional that will be apparent from the following discussion related to operation of the devices.

DISCUSSION OF OPERATION

A preferred embodiment of this invention, which has many of the above advantages, is FIG. 3, which uses two groups of sleeve type pistons, 32 and 34, that act in a telescoping manner with each other and between two angle block thrust plates, 49 and 148, used for camming means. The camming angles compliment each other to permit increase in the effective displacement angle without increasing the maximum angle, from an angle perpendicular to the shaft axis, that is normally used in inline piston type pumps. Increasing the displacement in this manner avoids the adverse forces, on the rotating elements, normally associated with greater displacement angles in prior art. In this invention the maximum displacement angle, from an angle perpendicular to the longitudinal axis of rotation, is designed to be no greater than that proven to be effective in prior art.

The advantage, in this invention, is that the displacement angle is effective on both sides of the said perpendicular angle. The result is construction of a device that has reduced size and weight over prior art of equal displacement in either the fixed or variable displacement mode of operation.

Although Piston 34, functions as the driving cylinder barrel for inner piston 32 similar to that described in patents #2,146,133, R. L. Tweedale, and patent #3,108,543, W. McGregor, it can also function without inner piston 32 in a rotary cylinder barrel shaft with the cylinder bore closed at one end to provide a different combination of advantages, such as discussed later in the description of FIGS. 7 and 8.

In FIG. 3 a hydrodynamic sliding fluid conduit bearing 50 abuts against fluid transfer valve plate 56, which has many of the characteristics of the bearing plates of prior art, except the novel advantage of this bearing plate is that; in addition to functioning as the bearing surface for bearing 50, it also rotates about its axis to follow bearing 50 and function as a valve plate to transfer fluid between bearing 50 and ports in the angle surface of valve block wear plate 49.

The novel advantage resulting from the fluid transfer valve plate 56 and bearing 50 moving together is that; velocity between these two critical bearing surfaces is greatly reduced, when compared to prior art pumps, thereby improving the pressure velocity wear characteristic. In this invention the velocity between the face of bearing 50 and fluid transfer valve plate 56 is reduced to; that resulting only from the elliptical movement of bearing 50 on the fluid transfer valve plate 56. The corresponding holes in details 52, 54 and 56, see FIG. 6, are designed to allow this movement without interference. In prior art, such as shown in FIG. 1, this elliptical movement occurs, however a significant high velocity movement resulting from the piston shoe abutting against a non-rotating bearing surface also occurs. This additional high velocity bearing surface movement has a direct bearing on unit life.

In furtherance to earlier discussion, pressure-velocity (PV) factors at piston shoe surfaces are a significant influence on the normal wearout and failure modes of prior art pumps. High velocity, between the piston shoe face 20 and its wear surface, is a speed limiting factor in prior art because of its negative influence on the load carrying capacity of the fluid film between the parts. Since this invention significantly reduces the velocity between the piston shoe face and its bearing surface, performance is improved over prior art due to less drag and service life due to less wear.

Another novel feature of the fluid transfer valve plate 56 is that; it combines the design functions of prior art parts generally known as the piston shoe wear plate and the face end of the cylinder barrel, sometimes called the cylinder block, into one part that carries the thrust loads from the bearing 50 to the angle block plus performs the valving function. These functions are performed by separate parts in designs well known to the art, such as shown in FIG. 1A. Combining the piston shoe bearing plate and valving functions in one part reduces fabrication and repair cost over those of prior art.

Another novel advantage over prior art such as discussed above is: in this invention the fluid transfer valve plate 56 is mounted in an antifriction bearing 48 which carries the piston retraction loads to the angle valve block 60. Prior art pumps, such as shown in FIG. 1, use a non-rotating retaining plate, that is in "sliding" contact with the rotating shoe retainer, for controlling the piston shoe clearance and transferring the piston extraction load to the angle block. This sliding bearing surface, see FIG. 1A location 30, is a frequent mode of failure because; breakdown at this surface, due to excessive load or wear, results in a resistance causing unacceptable wear at the driving piston shoe neck, see FIG. 1A location 26. Maximum allowable operating speed and minimum inlet pressure are affected by this bearing surface, which is a significant factor influencing the operating range of prior art. Using a ball or roller type bearing which has better load carrying capability, like bearing 48 is used in this invention claim, reduces forces resisting rotation of the piston shoe drive plate 52 to improve speed and inlet pressure characteristics.

Additional objects and advantages of the invention will become apparent from a consideration of the ensuing drawings, description and discussion of the elements of this invention.

DESCRIPTION OF DRAWINGS

Although some of the descriptions contained herein show a shaft as a means of transmitting torque to and from the device, it should be understood that; a shaft is only one of various methods that could be used for the input or output of rotational energy. Such as: fabricating the rotary cylinder barrel as an integral part of the rotor of an electric motor or generator; or fabricating it as an integral part of the hub of a gear in a gear type mechanical transmission.

FIG. 1 is a cross section view of a well known prior art inline piston type pump, which has the critical sliding bearing surfaces identified in FIG. 1A, to aid in understanding the discussion and comparison of this invention to prior art.

FIG. 2 is a cross section view of a prior art telescoping sleeve type pump to aid in understanding the discussion and comparison of my invention to this type prior art.

Figure 3:
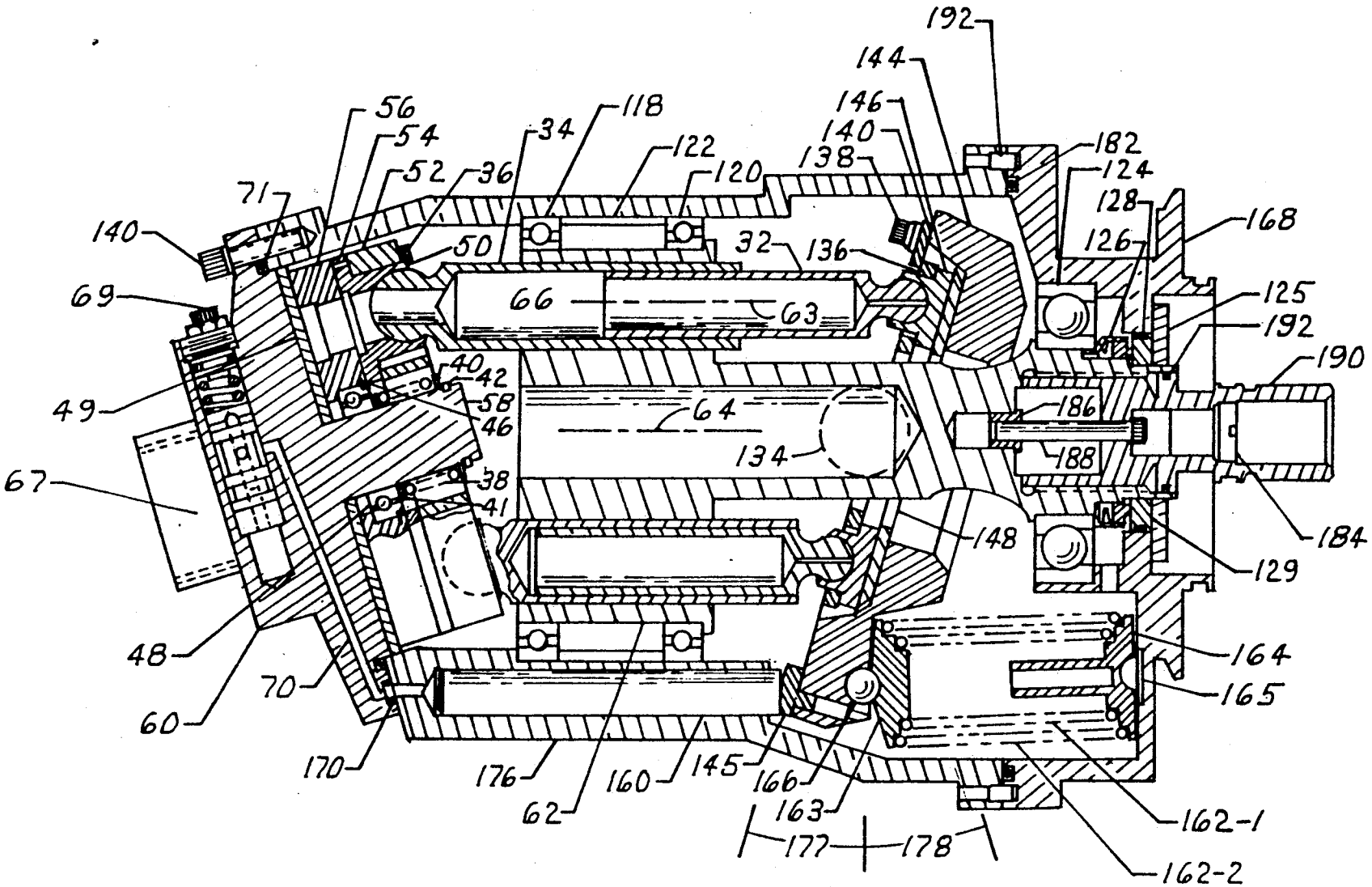
FIG. 3 is a cross section view, taken through line 3—3 of FIG. 4, of a preferred embodiment of the invention; which is a variable displacement pump in the arrangement shown.

Referring now in greater detail to FIGS. 3,4,5 and 6 which describe a preferred embodiment of my invention as a variable displacement pump. Input or output torque is transmitted by a rotary cylinder barrel shaft 62, having a major and minor diameter, with a plurality of cylinder bores machined through the major diameter, parallel with the shaft longitudinal axis 64 and disposed in an equally spaced circumferential array. Each bore is engaged in sliding contact by a sleeve type tubular shaped fluid conduit piston 34 that reciprocates parallel with longitudinal axis 64 of the shaft. An inner sleeve type piston 32 reciprocates in the hollow center cavity of outer piston 34, as a means for completing one end of pumping chamber 66. The outer sleeve type piston 34 is sufficiently hollow to permit the primary working fluid to flow through from end to end; and it is retained on the surface of the valve block wear plate 49 by being a part of mechanical valving device sub-assembly 68, see FIG. 5, which communicates with fluid of inlet arcuate slot 59, and outlet arcuate slot 61 of valve block wear plate 49, to complete pumping chamber 66.

Figure 6:
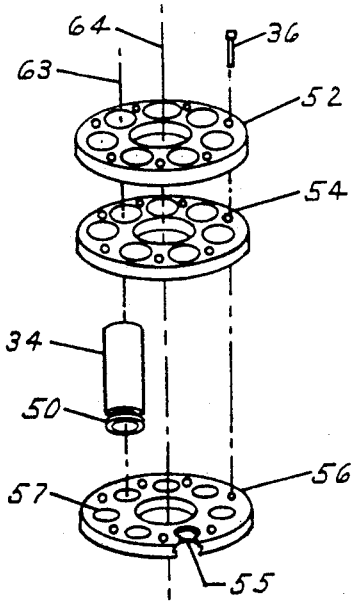
FIG. 6 is an exploded view of sub-assembly 68, in assembly sequence, including an isometric view of the fluid transfer valve plate 56 showing the step diameter holes 55 and 57.
Figure 5:
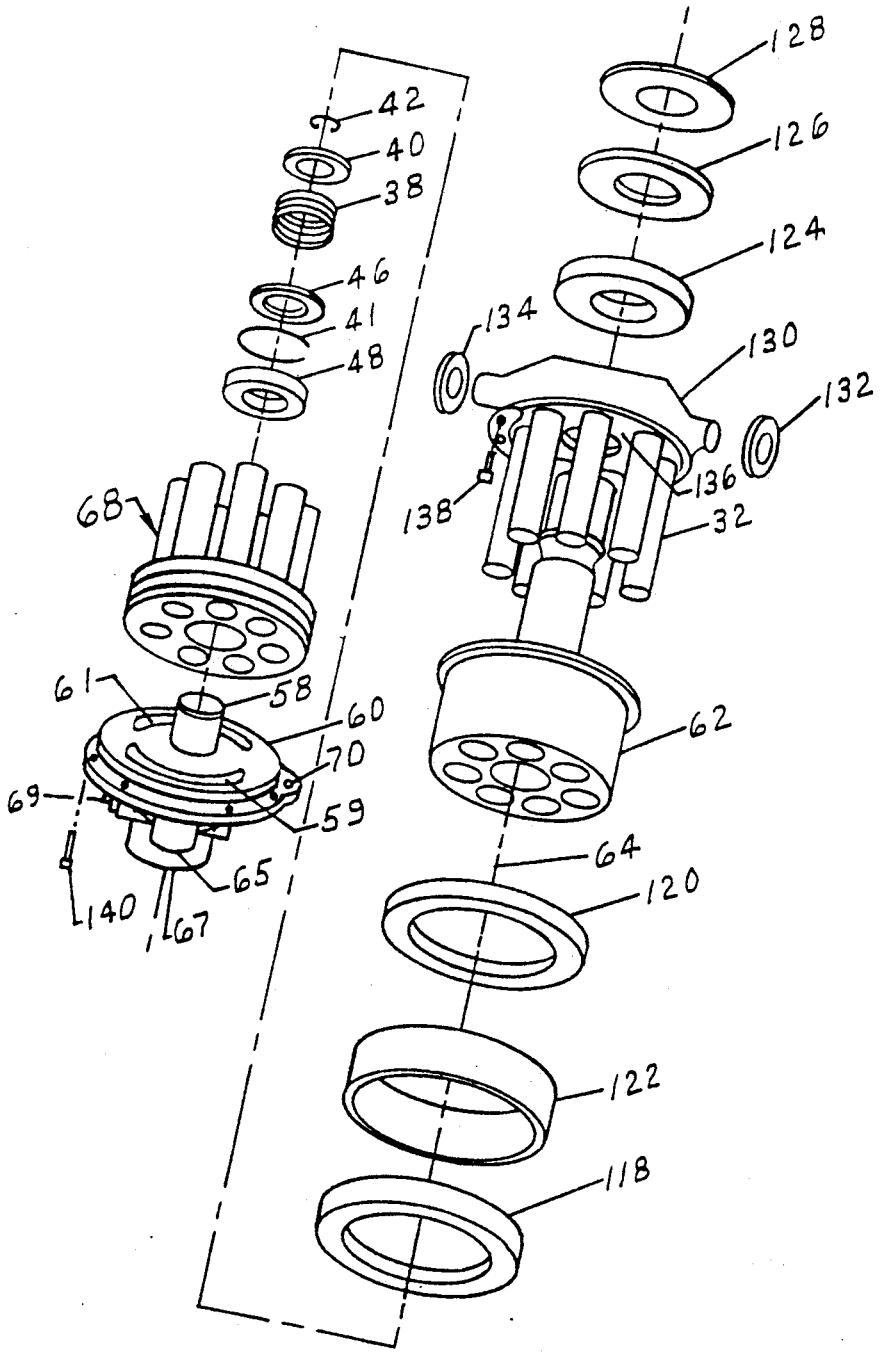
FIG. 5 is an exploded view showing certain elements of FIG. 3, in assembly sequence, with the casing and mounting flange structure excluded.

Drive plate 52, piston shoe spacer 54 and fluid transfer valve plate 56, are clamped together by fastener 36 to enclose the shoulder diameter of sliding fluid conduit bearing 50, which is fastened to piston 34 by a swaged ball joint, to form a mechanical valving device sub-assembly 68 as shown in FIG. 5 and 6. Sub-assembly 68 abuts against valve block replaceable wear plate 49, located on the surface of valve block 60, which is disposed at an angle to longitudinal axis 64 by the angle built into housing 176. Wear plate 49 is optional to reduce repair cost of valve block 60, in a manner well known to those familiar with the art. Wear plate 49 is intentionally not shown in FIG. 5 to illustrate this feature.

Valve block 60 and wear plate 49, thus form a fixed angle camming means and contain rotationally phased arcuate slots, 59 and 61, for properly timed communication with inlet and outlet fluid to complete a rotationally timed valving means. Bearing 48 is installed on bearing post 58, with a loose fit, and is held axially in place by retainer 46. If an interference fit is desired for bearing 48, bearing post 58 can be designed free to move to accommodate manufacturing tolerance stackup. It would be locked into position by a fastener at final assembly after a check was made to assure no "binding" of the assembled parts. Either way sub-assembly 68 is free to rotate. Sub-assembly 68 is held against valve block 60 by bearing 48, and spring 38, washer 41, and spring retainer 40. Spring retainer 40 is retained to post 58 by retainer 42. The load of spring 38 assures contact between the surfaces of fluid transfer valve plate 56 and valve block wear plate 49 when fluid forces are not sufficient to maintain the contact.

The width of spacer plate 54 is greater than the width of the shoulder flange of bearing 50 in order to avoid a clamping action on bearing 50 between the drive plate 52 and fluid transfer valve plate 56 when fastener 36 is in place. The holes in piston shoe spacer 54, as shown in FIG. 6, are designed to provide adequate clearance for the flange of bearing 50. This clearance is sufficient to permit bearing 50 to move freely in its elliptical path on the surface of fluid transfer valve plate 56. Drive plate 52 encompasses all pistons as shown in FIG. 6. The hole in drive plate 52 is large enough to accommodate the elliptical movement of bearing 50 neck and smaller than the maximum diameter of bearing 50 flange, so that drive plate 52 retains bearing 50 to extract outer piston 34 from its cylinder barrel in a manner well known to those familiar with the art.

The relationship between drive plate 52 and bearing 50 is designed such that; when rotary cylinder barrel 62 is rotated, the neck like smaller diameter of bearing 50 engages the holes in drive plate 52 to convey rotational energy to all the parts of sub-assembly 68 except piston 34 and drive them about an axis of rotation that corresponds with the longitudinal axis of valve block 60.

Bearing 50 is mounted to piston 34, with a swaged ball socket, and is designed as a sliding type hydrostatic fluid conduit bearing to carry the thrust loads of piston 34 to the surface of fluid transfer valve plate 56. Piston 34 and bearing 50 abut against and are free to move, in fluid contact and in a sliding motion, on the surface of fluid transfer valve plate 56 which abuts against the surface of valve block wear plate 49 such that; the piston 34 longitudinal axis 63 is not restrained from remaining inline with longitudinal axis 64 of rotary cylinder barrel shaft 62. The fluid conduit diameter of bearing 50 is designed such that; its relationship to the inner and outside diameters of bearing 50 creates a hydraulically balanced hydrostatic bearing between the bearing 50 face and the face of fluid transfer valve plate 56. A fluid seal is formed at this interface to prevent excessive leakage of working fluid. In this regard the piston shoe is well known to those familiar with the art. Sliding fluid conduit bearing 50 is sufficiently hollow to function as a conduit for fluid being worked.

Thrust forces from bearing 50 combine with force from spring 38 to constantly press fluid transfer valve plate 56 into engagement with the surface of wear plate 49; so that the clearance at these surfaces is automatically adjusted to take care of variations in viscosity of working fluid plus compensate for wear.

There are major and minor diameter fluid transfer holes 57 and 55 in fluid transfer valve plate 56, as shown in FIG. 6. These holes are on a bolt circle of the same diameter as used for the cylinder bores of rotary cylinder barrel shaft 62. They are designed to create part of a balancing force between the fluid transfer valve plate 56 and wear plate 49 when fluid pressure forces are present. The remaining thrust forces on fluid transfer valve plate 56 are fluid balanced by control of other areas on its' flat surface. When fluid transfer valve plate 56 rotates in abutting and fluid sealing relationship on the flat surface of wear plate 49, the resultant force is designed to be toward wear plate 49 such that, load carrying capability is optimum and leakage to the casing is minimized regardless of operating pressures. This relationship is well known to people familiar with the art. The concept is similar to that used to balance the cylinder block on the valve block surface of prior art pumps, such as shown in FIG. 1.

Rotationally phased arcuate slots 59 and 61 are machined into the surfaces of wear plate 49 and valve block 60 such that; they communicate with outlet 65 and inlet 67 system fluid passages located in valve block 60. A flat plate type valving means is thus completed to alternately connect the pumping chamber 66, to inlet or outlet system fluid with appropriately phased timing, for the efficient passage of said fluid to and from fluid transfer valve plate 56.

Figure 4:
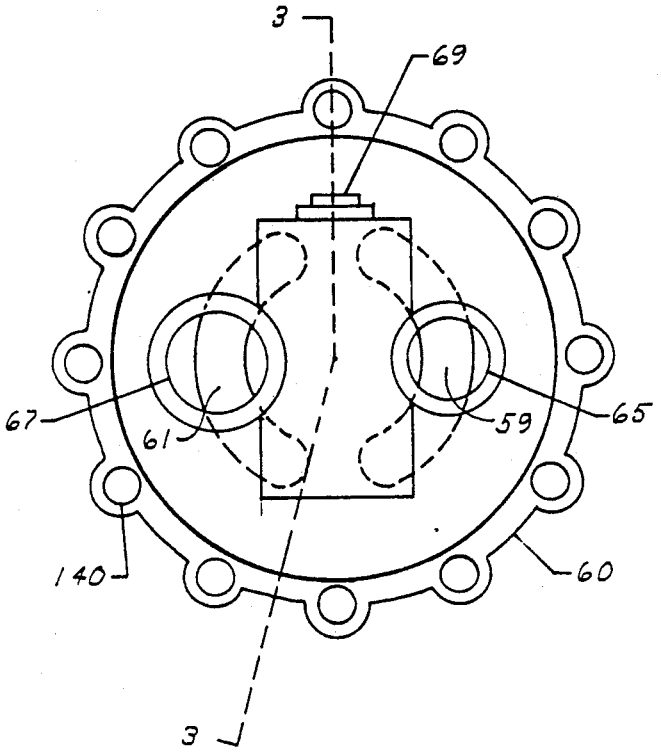
FIG. 4 is an end view of FIG. 3 showing disposition of arcuate slots and their relationship with the inlet and outlet system fluid attach points.

The threaded portion of fluid passage 67, in valve block 60, serves in a well known manner as the inlet system fluid attach point. A similar threaded attach point, see FIG. 4, is provided in outlet fluid passage 65. Valve block 60 serves to close the open end of housing 176 and is pressed into contact therewith by a series of bolts, 140, appropriately arrayed about its periphery. Static "O" ring type seal 71 prevents external leakage between valve block 60 and housing 176. Valve block 60 houses a typical pressure compensating valve mechanism, to automatically control output pressure, that is externally adjustable at nut 69. The internal mechanism of the pressure compensating valve is not described because it is well known to those familiar with the art. This mechanism provides fluid under pressure via fluid passage 70 to control piston 160. Other means of moving yoke 144 can be used as requirements of the application dictate. External leakage of control fluid is prevented by static "O" ring seal 170.

Radial loads on rotary cylinder barrel shaft 62 are accommodated by radial bearing 118 and radial thrust bearing 120. Thrust loads on rotary cylinder shaft 62 are transmitted through radial thrust bearing 120 to spacer 122, then through the outer race of bearing 118 to a shoulder, fabricated in housing 176 as part of support means for elements of the pump. Other radial and thrust loads acting on rotary cylinder barrel shaft 62 are transmitted through radial thrust bearing 124 to mounting flange 168 which serves to complete a casing around the mechanism by engaging a flat surface of housing 176. Flange 168 and housing 176 are located rotationally by pin 192 and pressed into contact by bolt fasteners, not shown, but properly arrayed about the periphery of the adjoining parts in a well known manner. A suitable case drain port, not shown, is located in housing 176 to return internal leakage to the system in a manner well known to the art. Static "O" ring seal 182 prevents external fluid leakage between parts 176 and 168. Shaft seal sub-assembly 126 rotates with rotary cylinder barrel shaft 62 and bears against sealing element 129 in sliding contact. Sealing element 129 is held in place by retainer 125, to complete the closure of the case and prevent excessive external fluid leakage around rotary cylinder barrel shaft 62. Static "O" ring seal 128 prevents external fluid leakage past the outside diameter of sealing element 129. Rotary cylinder barrel shaft 62 is fitted with a replaceable shaft coupling 190 in splined contact and retained by screw 188 and nut 186. Cap 184 closes the opening for screw 188 and "O" ring static seal 192 prevents loss of lubricant from the splined chamber to complete a drive and support means for the rotating elements of the pump.

Sleeve type piston 32 is coupled to piston shoe 146 in a swivel type swaged ball socket engagement. Piston shoe 146 is pressed into sliding engagement with the flat surface of bearing plate 148 when fluid pressure forces are present. Piston shoe retainer plate 136 encloses the neck of piston shoe 146 with sufficient clearance to allow elliptical movement of the shoe when movable tilt plate yoke 144 is displaced at an angle other than perpendicular to the axis of rotary cylinder barrel shaft 62. The clearance hole in shoe retainer plate 136 is smaller than the outside diameter of piston shoe 146 such that; piston shoe retainer plate 136 can serve to extract the sub-assembly of piston shoe 146 and sleeve type piston 32 during the inlet portion of the pumping action. Piston shoe retainer plate 136 is retained to yoke 144 by yoke retainer plate 140 which is held in place and fastened to yoke 144 by screw 138. These items make up yoke sub-assembly 130 as shown in FIG. 5. Yoke sub-assembly 130 is positioned in housing 176 by bearings 132 and 134. This arrangement of parts, which forms a tiltable yoke type camming surface, is similar in design to that shown in FIG. 1 and well known to those familiar with the art.

Sufficient clearance is provided in housing 176 and mounting flange 168 such that movable tilt plate yoke 144 can be rotated either to angle 177 or to angle 178. Control pressure, from the before mentioned pressure compensator valve mechanism, is supplied to control piston 160 which contacts bearing surface 145 to move yoke 144 and ball 166 against spring guide 163 to compress springs 162-1, -2 and which are retained by spring retainer 164 which is pressed into engagement with fulcrum 165 and free to pivot appropriately. This arrangement of elements forms novel adjusting means to regulate the camming angle of the camming means.

The camming angle of housing 176 plus yoke 144 and valve block 60 are rotationally positioned to interact with arcuate slots 59 and 61 such that pressure pulsations are minimized.

Figure 7:
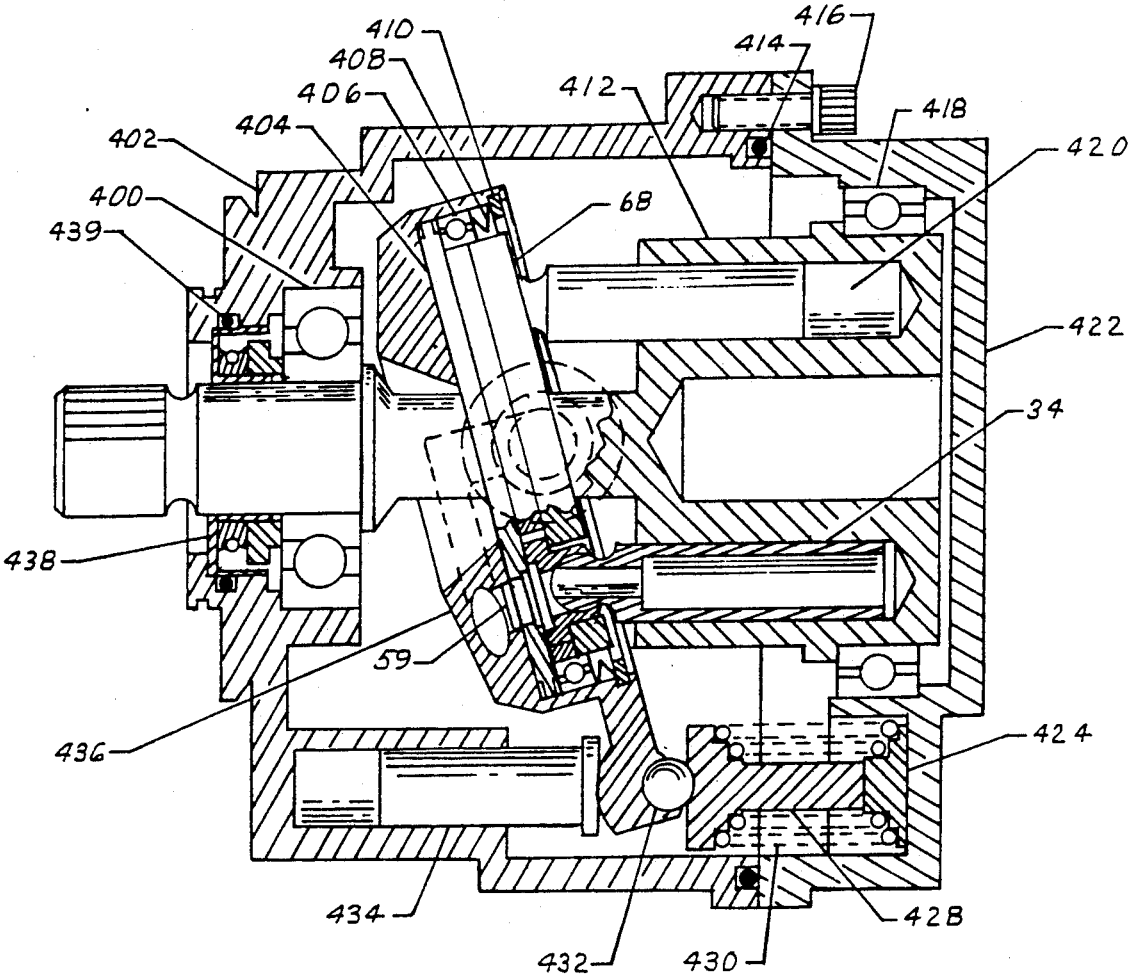
FIG. 7 is a cross section plan view, taken on line 7—7 of FIG. 8, to show another way that sub-assembly 68 can be utilized to provide a low profile variable displacement pump.
Figure 8:
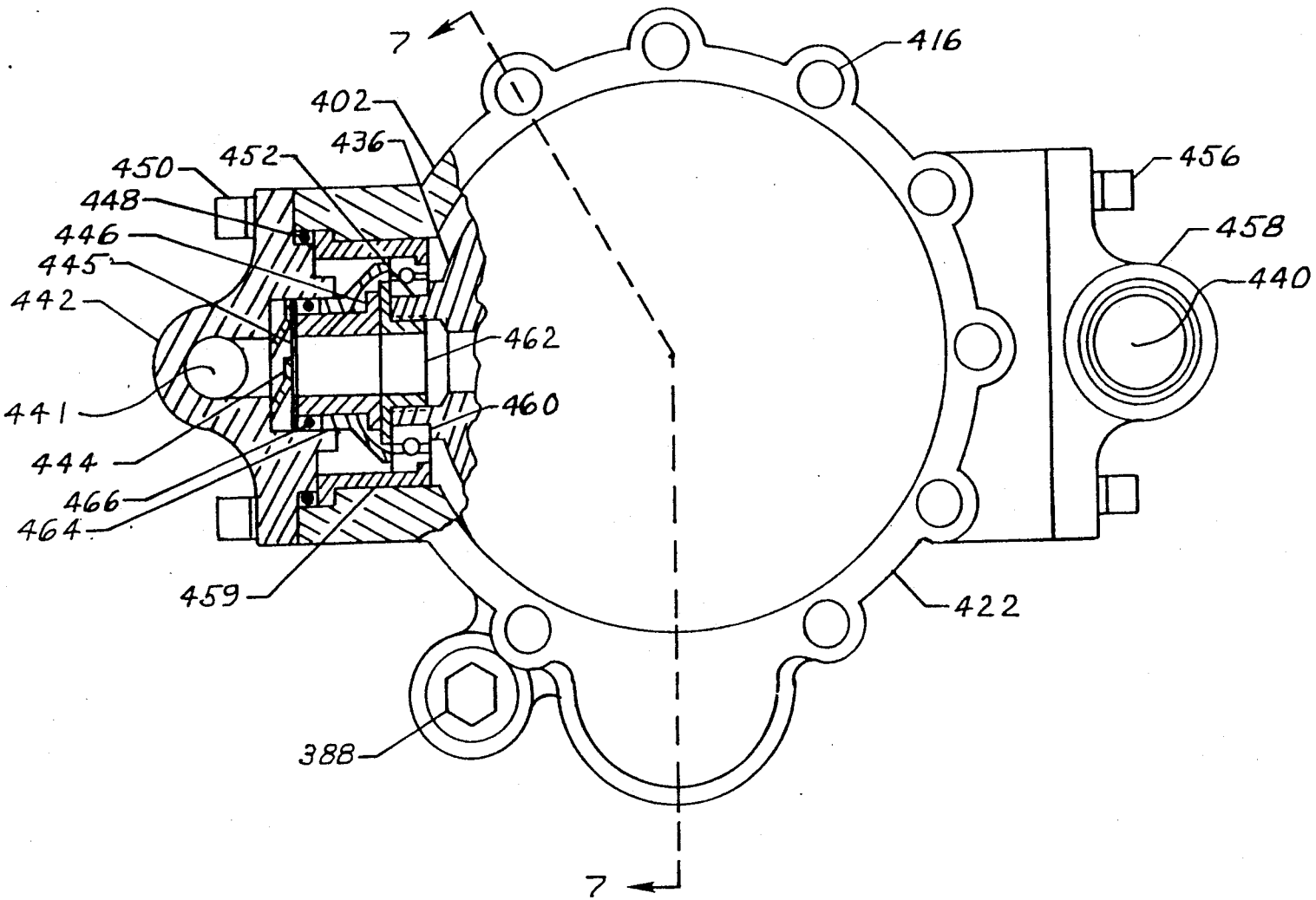
FIG. 8 is an end view of a low profile pump showing: one of multiple potential locations of a pressure compensating control device; one of multiple ways of supporting a tilt yoke-valve block; one of multiple ways of transferring system fluid to and from the pump. The hollow pintle sealing and system connect concept is similar to that used in patent #2,586,991, K. I. Postel.

Referring now in greater detail to FIGS. 7 and 8 which describe another embodiment of my invention as a low profile pump wherein; the valve block of prior art pumps has been eliminated by incorporating its function into the camming surface and pintle fluid passages of a tilt yoke. This approach reduces overhung moment and also removes the need for static seals on a highly stressed transverse plate type valve block that is subject to bending. Such seals can cause problems that require expensive sealing devices to resolve.

FIG. 7 is a cross section view of a low profile variable displacement pump taken on line 7—7 of FIG. 8 which includes; a housing 402 and end cap 422 fastened together with screws 416 that are circumferentially arrayed around the outside diameter for correct load distribution. An "O" ring type static seal 414 prevents fluid leakage between the adjoining flat surfaces of housing 402 and end cap 422 to complete a casing which has a rotary cylinder barrel shaft 412 suitably mounted in bearings 400 and 418, for rotation within said casing and about a shaft axis. The rotary cylinder barrel shaft 412 includes a plurality of cylinder bores, closed at one end and disposed in an equally spaced circumferential array, parallel to and surrounding the shaft longitudinal axis. A suitable shaft seal sub-assembly 438 prevents excessive external fluid leakage around the shaft exit from housing 402. Static "O" ring type seal 439 prevents external fluid leakage past shaft seal sub-assembly 438.

Mechanical valving device sub-assembly 68, as described fully in the description of FIGS. 3, 4, 5 and 6 is disposed in this embodiment with its sleeve type piston 34 engaged in sliding contact with the cylinder bores of rotary cylinder barrel shaft 412 to complete pumping chamber 420. In this embodiment of sub-assembly 68 the fluid transfer valve plate 404, previously referred to as item 56 in the description of FIG. 6, includes a shoulder on its outside diameter to engage the inner race of bearing 406. Wafer type spring 408 presses against retainer 410 and engages the outer race of bearing 406 to urge sub-assembly 68 into contact with the flat valving surface of movable tilt plate yoke valve block 436. This surface, of tilt yoke valve block 436, contains outlet fluid arcuate slot 59 and inlet fluid arcuate slot 61, previously described in the description of FIGS. 4, 5 and 6. These slots, 59 and 61, are disposed at a radius from the axis of rotary cylinder barrel shaft 412 that approximates the radius of the bolt circle for the closed cylinder barrels of rotary cylinder barrel shaft 412. Arcuate slots 59 and 61 are thereby positioned to appropriately communicate with the individual ports 55 in sub-assembly 68 that, in turn, are communicating with each sleeve type piston 34 and sliding fluid conduit bearing 50 of said sub-assembly 68. As the holes of sub-assembly 68 register with arcuate slot 59 and 61, they are alternately connected with inlet and outlet system fluid by separate fluid passages, 440 and 441, located within tilt yoke valve block 436 and exiting through hollow pintles 452 as shown in FIG. 8.

Figure 9:
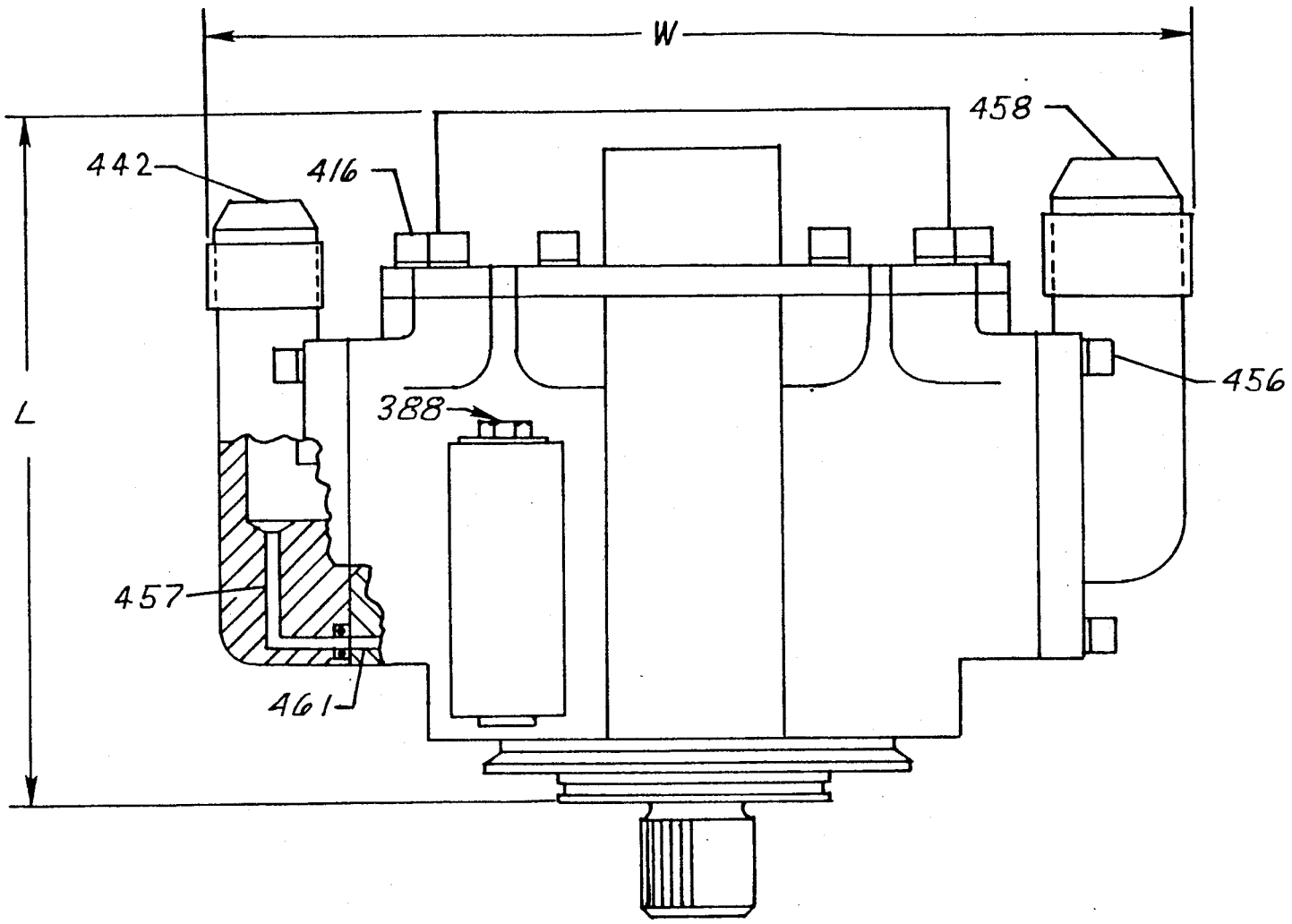
FIG. 9 is a plan view of a low profile pump showing the novel relationship of length L to width W plus one method of arranging the fluid system contact points.

The hollow pintles are located 180 degrees apart, extending from the outside diameter of tilt yoke valve block 436, and are supported by similar bearing and sealing arrangements. Only one hollow pintle, bearing, sealing and support arrangement will be described with the other being identical in design except of larger size due to the diameter of the fluid passage and thrust loads on the yoke. The pintle 452 of tilt yoke valve block 436 engages bearing 460 which is appropriately mounted in hanger 459 to transmit both radial and thrust loads to housing 402. A hollow replaceable sealing surface 462 is installed in the hollow pintle to continue the fluid passage and retain bearing 460. A similar hollow sleeve 446, with a shoulder having a flat sealing surface, engages replaceable sealing surface 462 in sliding contact. Spring 444 presses against flange 442 and washer 445 to urge parts 446 and 462 into engagement when fluid pressure is not present. The sealing surfaces of 446 and 462 are designed in a well known manner such that, when a deferential inlet to outlet fluid pressure is present it forces them into contact to avoid excessive leakage across the sealing surface. The loads acting on pintles 452 are carried by bearings 460. An "O" ring type static seal 466 engages spacer 464 to prevent fluid leakage past hollow sleeve seal 446. Flange 442 and 458 are properly machined for system attachments as shown in FIG. 9. Bolt and washer 450 firmly fasten flange 442 to housing 402 in several places appropriate to assure a secure contact. Static "O" ring seal 448 prevents external fluid leakage between flange 442 and housing 402.

Flange 458 and its included parts support the inlet pintle of tilt yoke 436 in the same manner as those associated with outlet flange 442 except that; they accommodate a larger diameter inlet fluid passage 440. See FIG. 8. Flange 458 is firmly fastened to housing 402 by bolt and washer 456.

Space is allocated in housing 402 near to the control piston 434 to accommodate a pressure compensating type valve well known to those familiar with the art. Pressure compensating valve adjustment screw 388 shows a location and orientation of a pressure compensating valve. The pressure compensating valve communicates with outlet fluid via fluid passage 461 in housing 402 that in turn communicates with fluid passage 457 in outlet flange 442. The pressure compensating valve reduces outlet pressure to a predetermined control pressure to operate control piston 434, which is in sliding contact with a cylinder bore in housing 402, and presses against movable tilt plate yoke valve block 436 to rotate it in pintle bearings 460; thereby changing the angle of tilt of the yoke such that relative motion between piston 34 and the cylinder barrel of rotary cylinder barrel shaft 412 is limited as a function of control pressure. The axial movement of control piston 434 is resisted by springs 430 that engage spring retainers 424 and 428 to exert a counter acting force on yoke 436 through ball 432. The pressure compensating valve also communicates with the hollow center of housing 402 to complete the control circuit in a manner well known to those familiar with the art; such as described in patent #2,586,991 to K. I. Postel, which also used yoke pintle sealing, bearing and flange arrangements similar to that described above.

FIG. 9 shows the relationship of width W to length L that is achieved in this invention; with length L being less than can be constructed with prior art of equal displacement. Although the system attach points, inlet flange 458 and outlet flange 442, are arranged parallel to the pump axis, there is freedom to move them in various directions depending on the requirement of the system envelope.

Figure 10:
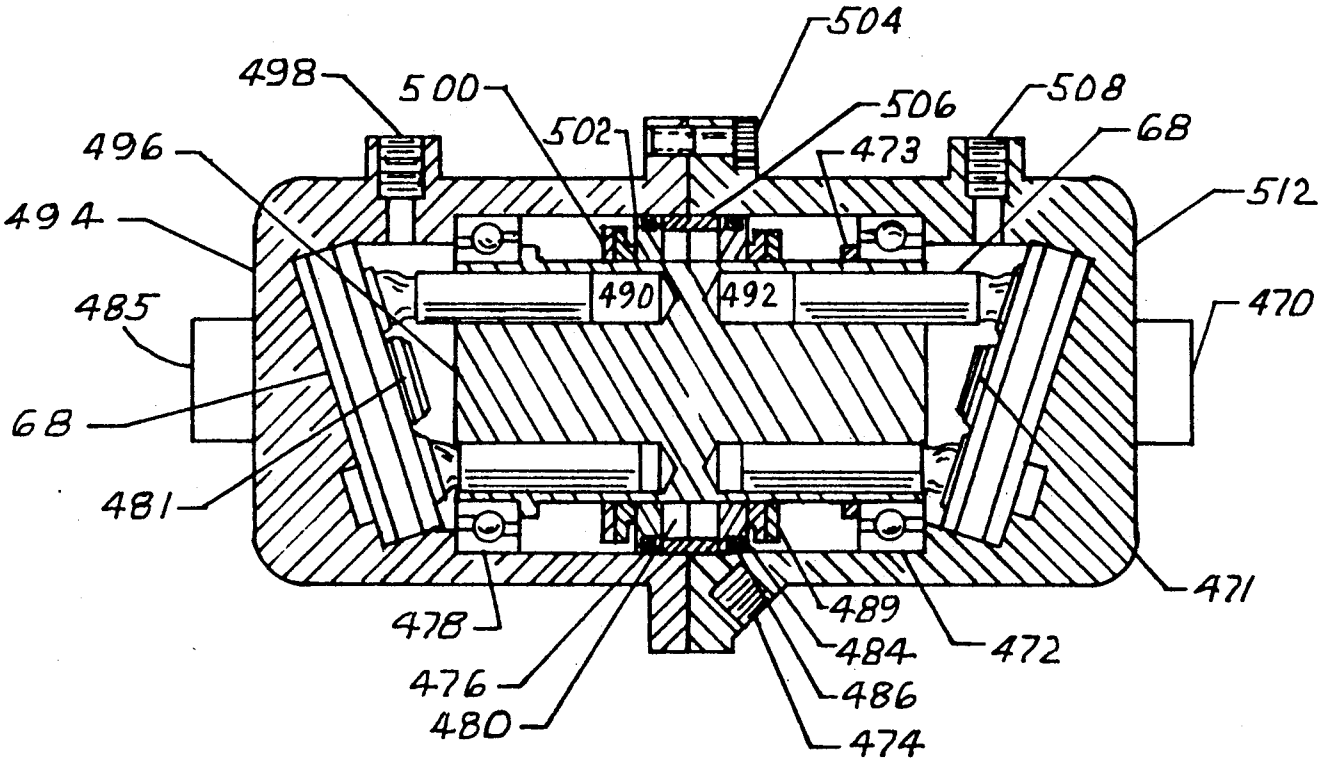
FIG. 10 is a cross section view, taken along line 10—10 of FIG. 11, to show a fluid motor/pump utilizing two sub-assembly 68; mounted in a common rotary cylinder barrel and encased in appropriate casing with supporting apparatus, to accomplish a driving motor function and a driven pump function in either direction of fluid power flow.
Figure 11:
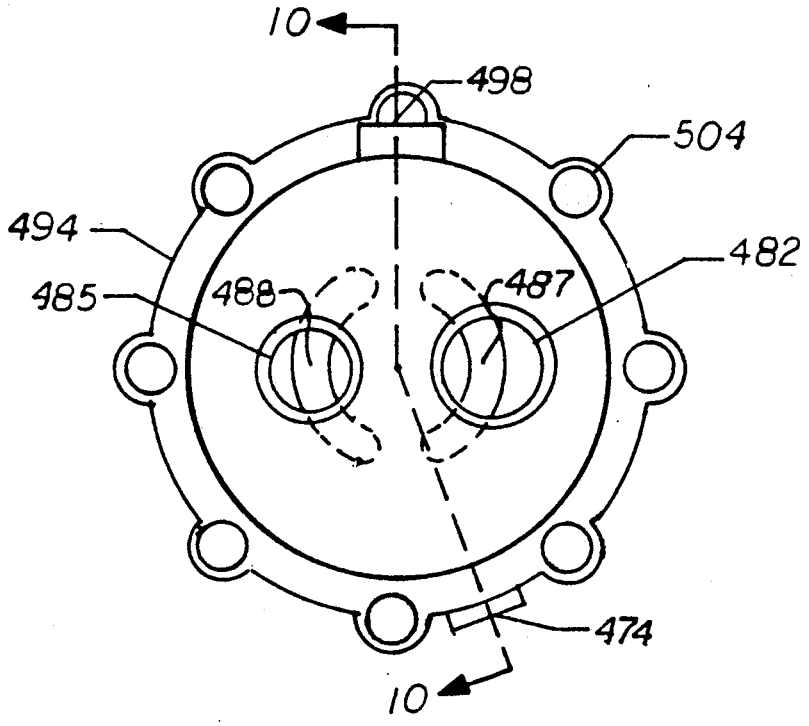
FIG. 11 is an end view of FIG. 10, showing a typical disposition of the arcuate slots and their relationship to the system fluid attach points.

Referring now in greater detail to FIGS. 10 and 11, which show an embodiment of my invention as a fluid motor-pump wherein; two mechanical valving device sub-assembly 68, as described fully in the description of FIGS. 3,4,5 and 6, are embodied in a common rotary cylinder barrel 496 to function, with appropriate casing and valving, to achieve a motor that operates in one fluid system or circuit, to drive a fluid pump that operates in a second fluid system or circuit, without permitting the working fluids of either system or circuit to mix one with the other. is feature is of particular benefit in transferring fluid power from one fluid system or circuit, to another.

FIG. 10 is a cross section view, taken along line 10—10 of FIG. 11, which ,is an end view of the device. These two figures are discussed together to assist in understanding the description of the mechanism. Housing 494, being open at one end, has a flange that receives the threaded end of bolt 504. The closed end of housing 494 contains system "a" inlet port 482, connected via fluid passage to inlet arcuate slot 487, and system "a" outlet port 485, connected via fluid passage to outlet arcuate slot 488, for communicating working fluid to and from system "a". Arcuate slots 487 and 488 are arranged on a flat surface of housing 494 with said flat surface being positioned at an angle to the longitudinal axis of rotation of rotary cylinder barrel 496. Sub-assembly 68 abuts against said angle flat surface of housing 494 to form a flat plate valving means by communicating with arcuate slots 487 and 488 in the same manner described earlier in FIG. 3, 4, 5, and 6. Sub-assembly 481 is an embodiment of the post and hold down apparatus described earlier in the description of FIG. 3 and performs the same function of urging sub-assembly 68 into contact with the mating flat valving surface of housing 494.

System "a" case drain port 498 is located, as shown, to drain internal fluid leakage back to system "a". Shaft seal sub-assembly 500 is mounted on the outside diameter of rotary cylinder barrel 496 and bears against shaft seal retainer bearing plate 502, in sliding contact, to form a dynamic fluid seal. Static "O" ring type seal 476 prevents fluid leakage between the inside diameter of housing 494 and the outside diameter of shaft seal retainer 502.

Rotary cylinder barrel 496 includes a plurality of cylinder bores, open at one end only, extending longitudinally from both ends of cylinder barrel 496 toward the middle, and arranged in a circumferential array that is equally spaced and parallel to the axis of rotation. None of the cylinder bores intersect. The pistons 34 of both sub-assemblies 68 engage the open ended cylinder bores, of cylinder barrel 496, in sliding contact to complete motor-pump chambers 490 and 492.

The cylinder bores at the opposite ends of rotary cylinder barrel 496 can be rotationally disposed, at the designers option, such that they are out of phase, one end to the other, and therefore interact with their respective valving surfaces out of phase to minimize pressure pulsations. The degree of this relationship is a function of the length and angular position of arcuate slots 59 and 61, as described in FIG. 4, plus the volume and type of fluid being worked.

Opposing housing 494 is housing 512, which is identical to housing 494, except that it includes shaft seal drain port 474 which drains chamber 480. The inside diameters of housings 494 and 512 are aligned by spacer 506. Radial thrust bearings 472 and 478 support rotary cylinder barrel 496 appropriately for rotation within the casing formed by housings 494 and 512. Shaft seal 483 is mounted on the outside diameter of rotary cylinder barrel 496 and bears in sliding contact with shaft seal retainer 484, to prevent excessive fluid leakage from system "b" to shaft seal chamber 480. Static "O" ring type seal 486 prevents leakage past the outside diameter of shaft seal retainer 484 into chamber 485. Sub-assembly 68 and post sub-assembly 481 are embodied a second time, identical to the embodiment associated with housing 494 except; they perform a motor or pump function opposite to that occurring at the other end of rotary cylinder barrel 496. Housing 512 includes system "b" case drain port 508 to return internal leakage to system "b".

An operational example is as follows: a torque is applied to rotary cylinder barrel 496 when there is a differential pressure difference between the arcuate slots of both sub-assembly 68 such that; rotary cylinder barrel 496 is caused to rotate by one sub-assembly 68 and thereby drive the opposite sub-assembly 68, depending on the relationship of the pressures. This action causes the device to function as a fluid motor-pump for the transfer of fluid power from one fluid system or circuit to another.

The pressure versus flow balance across the device can be adjusted by utilizing valving such as that described in patent #3,627,451, H. H. Kouns; or different camming angles; or different bolt circles for the piston cylinder barrels; or different diameter pistons; or some combination of these features. Should the application need such a feature, the yoke valve block arrangement, discussed in the description of FIGS. 7 and 8, can be used to vary the displacement of one or both of sub-assemblies 68 of FIG. 10.

SUMMARY AND CONCLUSION

In general there exists long felt needs of system designers for fluid power transmissions that are: smaller in size, lighter in weight, less costly to fabricate and yet; have superior performance, are more reliable, give longer service life and are less costly to repair. It is true that these are long felt needs in many technologies. However, as shown in the forgoing descriptions and discussion, this invention addresses all of these needs in one way or another for the fluid power system designer; regardless of the industry using the technology such as aerospace, machine tool, robotics or automotive, to name several.

In recent years inline piston type pumps, being well known to those familiar with the art and a commercial success, have been limited primarily to advances in technology of materials and fabrication procedures. This limitation has emphasized the above mentioned long felt needs, and caused a desire for more innovative and productive improvements, to make high pressure piston type pumps more competitive with other means of providing fluid power.

The descriptions, and operational discussion of this invention's embodiments, explain some of the ways the above needs are partially resolved with innovative and unusual means. Improvements are accomplished through utilization of a novel mechanical valving device that integrates a method to; accommodate the load carrying and sliding motion of hydrodynamic fluid conduit bearings with fluid valving means at the camming end of working pistons.

Embodiment of these betterments, in fluid power components, produces unusual and surprising results which address the increasing demand for fluid power systems that; do more reliable work at reduced weight and are smaller plus operate at lower cost to the user. In addition, through the redistribution of certain loads plus more efficient use and location of critical surfaces, this invention enhances the designers options for utilizing the rapidly advancing technology in materials and fabrication methods.

The following objectives are achieved to produce the results discussed above:

(a)operation of telescoping sleeve type pistons with a rotary cylinder barrel in such a way as to increase working fluid displacement per unit volume of pump, (b)combining separate groups of pumping elements in such a way that bearing loads are shared thereby reducing the number of individual bearings required, (c)improving the operating condition of certain sliding parts, (d)eliminating certain parts, (e)eliminating certain static fluid sealing needs on highly stressed flat beam type surfaces, (f)decreasing the length of the longitudinal axis about which the pumping elements rotate to improve vibration characteristics Achievement of these objectives provide the advantages that address the before mentioned long felt needs. Some objectives operate together to produce desired results and others accomplish specific improvements independently.

While the descriptions and discussion contain many specificities, these should not be construed as limitations on the scope of the invention, but rather as exemplifications of preferred embodiments thereof. Many other variations are possible. For example:

(I) integrating the rotary cylinder barrel as a part of the rotor of an electric motor to obtain an additional group of advantages such as those identified by patent #3,295,457, H. G. Oram.

(II) separating the housings and elongating the rotary cylinder barrel of FIG. 10 such that the rotary cylinder barrel can also function as the axle of a vehicle or some other torque shaft type application, (III)integrating the cylinder barrels into the hub of a wheel for a low cost fluid power driven vehicle such as a front wheel driven automobile that, heretofore, uses expensive and inefficient universal joints for transmitting the power from the engine to the wheels, (IV) integrating the rotary cylinder barrel into the hub of a gear installed in a gear box; to reduce weight and complexity by eliminating the coupling shaft arrangements commonly used to drive accessories mounted on the exterior of the gearbox, (V) fabricating the cylinder bores of the rotary cylinder barrel at some angle other than parallel to the longitudinal axis of rotation to enhance certain operating characteristics, (VI) utilizing an arrangement similar to FIG. 10 which includes mechanical or electrical means to transmit rotational energy to and from rotary cylinder barrel 496, (VI) utilizing nonmetallic materials to construct some or all of the devices, The above are understood to be examples and should not be considered to be limitations of the scope of the invention. Accordingly, the scope of the invention should be determined, not by the embodiments illustrated or suggested but, by the appended claims and their legal equivalents.

What is claimed is:

1. A fluid power mechanical valving device comprising;

(a) a plurality of tubular shaped fluid conduits arrayed in a circumferential manner to rotate around a common longitudinal axis, each said tubular shaped fluid conduit has sufficient longitudinal hollow cavity for fluid to flow through from end to end, (b) a sliding fluid conduit bearing means, disposed in a swivel manner, at one end of each said tubular shaped fluid conduit, (c) a fluid transfer valve plate which is engaged, in sliding contact, by said sliding fluid conduit bearing means for transferring fluid to and from fluid passages of said valve plate; axial load from said tubular shaped fluid conduit acts on said bearing means to urge said valve plate to abut a surface of a corresponding plate, in sliding contact, to achieve efficient transfer to fluid between said fluid passages of said valve plate, and ports located on said surface of said corresponding plate, (d) a sub-assembly enclosure means that grasps said sliding fluid conduit bearings in such a way as to permit limited lateral movement of said bearings on said valve plate surface and also limit axial movement of said bearings, (e) a torque means which transmits rotational energy to said sub-assembly, by grasping and rotating said tubular shaped fluid conduits about a longitudinal axis, which causes rotational contact between said bearing means and a member of said sub-assembly enclosure means, (f) whereby a valving device occurs based on the overall cooperation between said rotating tubular fluid conduits, said sliding fluid conduit bearing means, said fluid transfer valve plate, said sub-assembly enclosure means and said torque means.

2. A fluid power mechanical valving device as set forth in claim 1 wherein; certain axial loads, that occur on said sliding fluid conduit bearing are transmitted through said grasping device to a mechanical anti-friction bearing which in turn transmits said loads to a member of a support means.

3. A rotary fluid power transmission comprising:

(a) a rotary cylinder barrel which has a plurality of cylinder bores arrayed in a circumferential manner around a longitudinal axis, said rotary cylinder barrel is disposed to rotate about said longitudinal axis, (b) a torque means to transmit rotational energy to and from said rotary cylinder barrel, (c) a tubular shaped fluid conduit piston, that has sufficient hollow cavity to function as a conduit for fluid to flow through from end to end, and is disposed to reciprocate in each said cylinder bore, (d) a closure means for said cylinder bores thus completing fluid pumping chambers, (e) a sliding fluid conduit bearing means that is disposed at one end of each said piston, (f) a fluid transfer valve plate that is engaged in sliding contact by said sliding fluid conduit bearing means for transferring fluid to and from fluid passages of said bearing means and said fluid transfer valve plate, (g) an angle plate type camming means, that has fluid passage ports located on its camming surface, which is engaged by said valve plate in sliding contact to efficiently transfer fluid between said fluid passages of said valve plate and said fluid passage ports of said camming surface; axial load from said pistons acts on said bearings to urge said fluid transfer valve plate to abut said camming surface, (h) a sub-assembly enclosure means that grasps said sliding fluid conduit bearings, in such a way, as to permit limited lateral movement of said bearings on said valve plate surface, and also limit axial movement of said bearings, (i) a torque means which transmits rotational energy to said sub-assembly enclosure means, by said rotary cylinder barrel engaging said tubular shaped fluid conduits in sliding contact and rotating them about said longitudinal axis, which causes rotational contact between said bearing means and a member of said sub-assembly enclosure means, (j) a support means that contain the elements of said rotary fluid power transmission in their correct alignment and position plus accommodates resultant thrust and radial loads, (k) a fluid communication means, including fluid ports and passages, for handling flow of fluid to and from said fluid passage ports of said angle plate type camming means.

4. A rotary fluid power transmission as set forth in claim 3 wherein said torque means for transmitting rotational energy is a shaft suitably disposed as part of said rotary cylinder barrel.

5. A rotary fluid power device as set forth in claim 3 including an adjusting means for regulating said camming means which comprises; a movable tilt plate for changing said camming angle of said camming means such that, volume of said fluid pumping chambers is varied by moving said tilt plate either side of an angle perpendicular to the longitudinal axis of rotation.

6. A rotary fluid power device as set forth in claim 3 wherein said cylinder bores extend completely through the length of said rotary cylinder barrel and said closure means comprises:

(a) secondary pistons that engage, in sliding contact, each said hollow cavity of each said tubular shaped fluid conduit piston and extend therefrom, (b) a shoe type bearing that is disposed, with a swivel type engagement, at the end of each said secondary piston, (c) a secondary camming means that is suitably supported and is engaged in sliding contact by said shoe type bearing of said second piston, (d) a means to grasp said shoes of said secondary pistons to partially extract said secondary pistons from said hollow cavities plus accommodate movement between said secondary piston shoes and said secondary camming means such that, said second piston's longitudinal axis remains in proper alignment with longitudinal axes of said hollow cavities.

7. A rotary fluid power transmission as set forth in claim 6, including a means for regulating said camming means which comprises; a movable tilt thrust plate for regulating the camming angle of said secondary camming means such that, volume of said pumping chambers can be varied from maximum to minimum by moving said tilt plate, from an angle disposed to one side of an angle perpendicular to a longitudinal axis of rotation, to an angle on the opposite side of said perpendicular angle; without changing the direction of flow in fluid passages.

8. A rotary fluid power transmission as set forth in claim 6 wherein said adjusting means for regulating said camming means comprises; a movable tilt plate for controlling the camming angle of said camming means and a movable tilt plate for controlling the camming angle of said secondary camming means such that volume of said pumping chambers can be varied.

9. A rotary fluid power transmission as set forth in claim 6 wherein said adjusting means for regulating said camming means comprises; apparatus for rotating either camming means about its longitudinal axis for attaining a relationship of said fixed camming angles of said camming means such that volume of said pumping chambers are varied.

10. A rotary fluid power transmission as described in claim 3 wherein said cylinder bores of rotary cylinder barrel are closed at one end, with said cylinder bore open end being engaged in sliding contact by said tubular shaped fluid conduit pistons.

11. A rotary fluid power transmission as described in claim 10, including an adjusting means for regulating said camming means which comprises;

(a) a movable tilt valve plate camming means for changing said angle of said camming means such that volume of said fluid pumping chambers is varied, said movable tilt valve plate camming means includes internal fluid passages that connect ports, on a surface of said camming means, with hollow fluid conduit support pintles that extend from said tilt valve plates' periphery; said support pintles being suitably mounted in support apparatus to form a pivot, about a longitudinal axis of said pintles, for said movable tilt plate camming means to rotate, in oscillating motion during adjustment of said camming angle, (b) said pintles of said movable tilt plate camming means engage fluid passages of said support apparatus in sliding contact to efficiently transfer fluid to and from said movable tilt valve plate camming means.

12. A rotary fluid power transmission, as described in claim 3, wherein said cylinder bores are contained in a rotary cylinder barrel and extend longitudinally from each end toward the other end to form bore type cavities which are closed at one end with no two cylinder bores intersecting one with the other, said cylinder bores are arrayed in a circumferential manner along the longitudinal axis of rotation, said cylinder bores, at each end of said rotary cylinder barrel, are engaged in sliding contact with separate rotating groups of said tubular shaped fluid conduit pistons said rotational energy is provided by causing differential pressures to exist in said camming surface ports associated with either end of said rotary cylinder barrel.

13. A rotary fluid power device as set forth in claim 12, including adjusting means for regulating said camming means which comprises a movable tilt valve plate camming means for controlling the camming angle of said camming means at one end of said rotary cylinder barrel such that volume of said pumping chambers is varied, or reversed, by moving said tilt plate either side of an angle perpendicular to the longitudinal axis of rotation.

14. A rotary fluid power transmission as set forth in claim 13 wherein said adjusting means is utilized at both ends of said rotary cylinder barrel.

* * * * *